US006274983B1

(12) United States Patent
Ooyama et al.

(10) Patent No.: US 6,274,983 B1
(45) Date of Patent: Aug. 14, 2001

(54) HIGH PRESSURE MERCURY LAMP WITH PARTICULAR ELECTRODE STRUCTURE AND EMISSION DEVICE FOR A HIGH-PRESSURE MERCURY LAMP

(75) Inventors: Masachika Ooyama, Himeji; Tomoyoshi Arimoto, Tatsuno; Kazuhiro Goto, Himeji, all of (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/353,283

(22) Filed: Jul. 14, 1999

(30) Foreign Application Priority Data

Jul. 14, 1998 (JP) ..... 10-213443
Apr. 12, 1999 (JP) ..... 11-104644

(51) Int. Cl.[7] ..... H01J 17/04; H01J 61/04

(52) U.S. Cl. ..... 313/632; 313/631; 313/634; 313/639; 313/642

(58) Field of Search ..... 313/632, 631, 313/639, 634, 642, 643, 623, 571, 573, 574

(56) References Cited

U.S. PATENT DOCUMENTS 4,422,011 * 12/1983 Bruninx-Poesen et al. ..... 313/642
4,799,135 * 1/1989 Inukai et al. ..... 362/296
4,870,316 * 9/1989 Otani ..... 313/25
5,109,181 4/1992 Fischer et al. ..... 313/571
5,420,477 * 5/1995 Sims et al. ..... 313/631
5,497,049 * 3/1996 Fischer ..... 313/634

FOREIGN PATENT DOCUMENTS 197 47 803 5/1998 (DE) .
0 901 151 3/1999 (EP) .

* cited by examiner

*Primary Examiner*—Vip Patel
*Assistant Examiner*—Kevin Quarterman
(74) *Attorney, Agent, or Firm*—Nixon Peabody LLP; David S. Safran

(57) ABSTRACT

The invention relates to a high pressure mercury lamp which is operated with an internal pressure at least equal to one hundred and some dozen atm and in which the thermal load and gas convection are considered. A fused silica glass discharge vessel is filled with mercury in an amount at least equal to 0.15 mg/mm$^3$ and rare gas. The length of the electrode which projects into the discharge vessel and which is positioned at the top is greater than the length of the electrode which projects into the discharge vessel and which is positioned at the bottom. Where the lamp wattage is W (W) and the maximum value of the inside diameter in the direction perpendicular to the axis which extends between the pair of electrodes within the discharge vessel is D (mm), the following conditions are met:

$$0.35\times(W)^{1/2} \leqq L1 \leqq 0.69\times(W)^{1/2}$$

$$L2 \leqq 0.76\times(W)^{1/2.64}$$

and at the same time $$(2.50)e^{0.0022W} \leqq D \leqq (5.0)e^{0.0034W}.$$

27 Claims, 3 Drawing Sheets

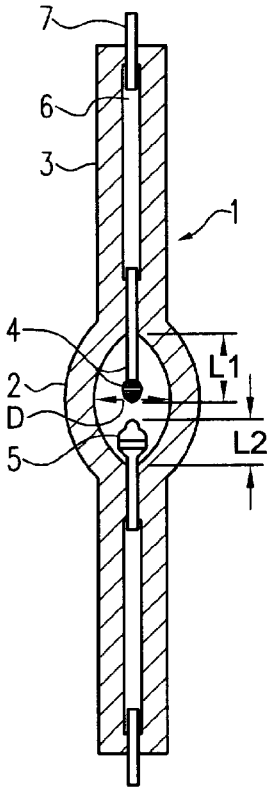
FIG. 1
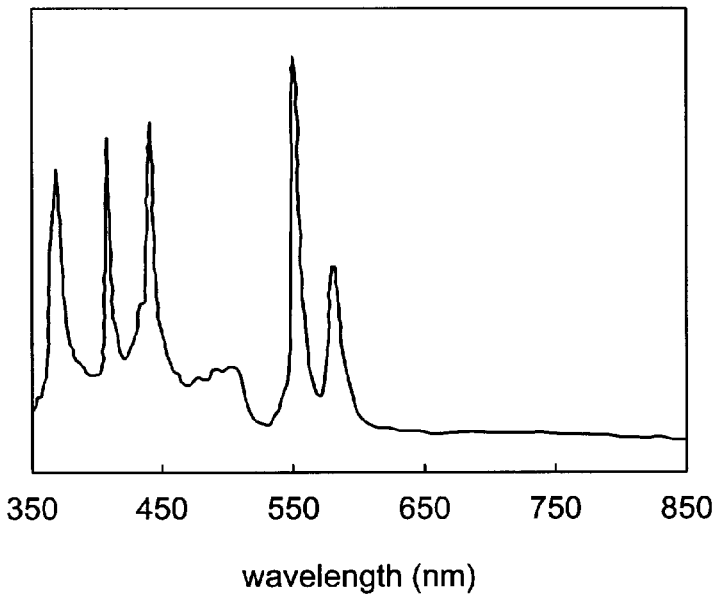
FIG. 2
| lamp power | lower boundary value of D | upper boundary value of D | lower boundary value of L1 | upper boundary value of L1 | upper boundary value of L2 |
|---|---|---|---|---|---|
| (W) | (mm) | (mm) | (mm) | (mm) | (mm) |
| 75 | 4.552 | 5.046 | 3.031 | 5.976 | 3.900 |
| 100 | 4.810 | 5.493 | 3.500 | 6.900 | 4.349 |
| 125 | 5.082 | 5.981 | 3.913 | 7.714 | 4.733 |
| 150 | 5.369 | 6.511 | 4.287 | 8.451 | 5.071 |
| 175 | 5.673 | 7.089 | 4.630 | 9.128 | 5.376 |
| 200 | 5.993 | 7.718 | 4.950 | 9.758 | 5.655 |
| 225 | 6.332 | 8.403 | 5.250 | 10.350 | 5.913 |
| 250 | 6.690 | 9.148 | 5.534 | 10.910 | 6.154 |
FIG. 3

| lamp No. | lamp wattage W | amount of mercury mg/mm | L1 mm | L2 mm | D mm | AL mm | con-dition 1 | con-dition 2 | con-dition 3 | con-dition 4 | test result |
|---|---|---|---|---|---|---|---|---|---|---|---|
| 1 | 130 | 0.155 | 5.0 | 5.0 | 5.8 | 1.0 | X | O | X | O | In the lower region of the discharge vessel the mercury has not completely vaporized. It is not possible to obtain a sufficient operating pressure. |
| 2 | 130 | 0.155 | 8.0 | 4.0 | 5.8 | 1.0 | O | X | O | O | In the upper region of the discharge vessel the mercury has not completely vaporized. It is not possible to obtain a sufficient operating pressure. |
| 3 | 130 | 0.155 | 6.7 | 3.0 | 8.0 | 1.3 | O | O | O | X | In the middle region of the discharge vessel the mercury has not completely vaporized. It is not possible to obtain a sufficient operating pressure. |
| 4 | 130 | 0.215 | 3.8 | 3.0 | 5.9 | 1.0 | O | X | O | O | In the upper region of the discharge vessel devitrification occured roughly 2100 hours after the start of operation. |
| 5 | 130 | 0.215 | 6.7 | 3.0 | 3.0 | 1.3 | O | O | O | X | In the upper region of the discharge vessel devitrification occured roughly 1800 hours after the start of operation. |
| 6 | 130 | 0.215 | 6.7 | 3.0 | 5.9 | 1.3 | O | O | O | O | Roughly 5000 hours after the start of operation a degree of maintenance of the light flux of 60 % was confirmed. |
| 7 | 200 | 0.155 | 6.0 | 6.0 | 7.4 | 1.8 | X | O | X | O | In the lower region of the discharge vessel the mercury has not completely vaporized. It is not possible to obtain a sufficient operating pressure. |
| 8 | 200 | 0.155 | 10.0 | 5.5 | 7.4 | 1.8 | O | X | O | O | In the upper region of the discharge vessel the mercury has not completely vaporized. It is not possible to obtain a sufficient operating pressure. |
| 9 | 200 | 0.155 | 7.4 | 3.5 | 10.0 | 1.5 | O | O | O | X | In the middle region of the discharge vessel the mercury has not completely vaporized. It is not possible to obtain a sufficient operating pressure. |
| 10 | 200 | 0.175 | 4.9 | 3.5 | 7.4 | 1.5 | O | X | O | O | In the upper region of the discharge vessel devitrification occured roughly 1900 hours after the start of operation. |
| 11 | 200 | 0.195 | 7.4 | 3.5 | 3.7 | 1.5 | O | O | O | X | In the upper region of the discharge vessel devitrification occured roughly 1600 hours after the start of operation. |
| 12 | 200 | 0.195 | 7.4 | 3.5 | 7.4 | 1.5 | O | O | O | O | Roughly 5000 hours after the start of operation a degree of maintenance of the light flux of 53 % was confirmed. |

FIG. 6

HIGH PRESSURE MERCURY LAMP WITH PARTICULAR ELECTRODE STRUCTURE AND EMISSION DEVICE FOR A HIGH-PRESSURE MERCURY LAMP

BACKGROUND OF THE INVENTION

1. Field of the Invention

The invention relates to a high pressure mercury lamp and an emission device for a high pressure mercury lamp. The invention relates especially to a super high pressure mercury lamp in which a discharge vessel is filled with mercury in an amount at least equal to 0.15 mg/mm$^3$, in which furthermore the mercury vapor pressure during operation is at least equal to a hundred and some dozen atm, and which is used as a backlight of a liquid crystal display device of the projection type or the like.

2. Description of the Related Art

In a liquid crystal display device of the projection type, there is a demand for operation of its light source in a horizontal operating position in order to keep the height of the device low. Furthermore, there is a demand for illumination of images onto a rectangular screen in a uniform manner and with adequate color reproduction. Therefore, a metal halide lamp of the horizontal operating type is used as the light source and is filled with mercury and a metal halide. Furthermore, recently, smaller and smaller metal halide lamps, and more and more often point light sources have been produced, and lamps with extremely small dimensions between the electrodes have been used in practice.

Against this background, instead of metal halide lamps, lamps with an extremely high mercury vapor pressure, for example, with a pressure at least equal to 200 bar (roughly 197 atm), have recently been proposed. Here, the increased mercury vapor pressure suppresses broadening of the arc (the arc is contracted) and a considerable increase of the light intensity is desired; this is disclosed, for example, in Japanese patent disclosure document HEI 2-148561 (U.S. Pat. No. 5,109,181) and in Japanese patent disclosure document HEI 6-52830 (U.S. Pat. No. 5,497,049).

In Japanese patent disclosure document HEI 2-148561 (U.S. Pat. No. 5,109,181), a high pressure mercury lamp is disclosed in which a discharge vessel which has a pair of tungsten electrodes is filled with a rare gas, at least 0.2 mg/mm$^3$ mercury and a halogen in the range from $1\times10^{-6}$ to $1\times10^{-4}$ $\mu$mol/mm$^3$, and which is operated with a wall load at least equal to 1 W/mm$^2$.

The following can be taken from this publication:

The reason for the amount of mercury added being greater than or equal to 0.2 mg/mm$^3$ is to raise the mercury pressure, to increase the number of continuous spectra in the visible radiation range, especially in the red range, and to improve the color reproduction. The reason for the tube wall load of greater than or equal to 1 W/mm$^2$ is to increase the temperature in the coolest portion in order to increase the mercury pressure. The reason for adding a halogen is to prevent blackening of the tube wall.

On the other hand, Japanese patent disclosure document HEI 6-52830 (U.S. Pat. No. 5,497,049) discloses that, in addition to the above described amount of mercury, the value ofthe tube wall load, and the amount of halogen, the shape of the discharge vessel and the distance between the electrodes is fixed and furthermore bromine is used as the halogen.

Here, the following is shown:

The reason for adding the bromine is to prevent blackening of the tube wall. When at least $10^{-6}$ $\mu$mol/mm$^3$ bromine is added, an adequate effect is achieved. At amounts greater than $10^{-4}$ $\mu$mol/mm$^3$, etching of the electrodes occurs.

On the other hand, one such super high pressure mercury lamp is operated horizontally, i.e., it is operated in such a way that the virtual line which forms between the electrodes is parallel to the horizontal. In this case, as a result of the floating of the arc which forms between the electrodes in the upper region of the discharge vessel, the thermal load is extremely high, while in the lower area of the discharge vessel, the thermal load becomes low. To obtain a high operating pressure of the mercury, it is necessary to make the discharge vessel smaller, i.e., to reduce the inside diameter of the emission space. However, if the latter becomes too small, the fused silica glass comprising the discharge vessel crystallizes. The range of reduction of the discharge vessel is therefore limited.

On the other hand, recently, a liquid crystal projection television has attracted attention; in it, in the main part of the television, there is a discharge lamp as the light source for purposes of illumination from behind the television picture, i.e., a so-called rear projection type television. In this television, the discharge vessel need not necessarily be operated horizontally with respect to optical construction, but it can also be operated vertically.

In vertical operation of the above described super high pressure mercury lamp, the effect of the thermal load within the discharge vessel is completely different than in the case of horizontal operation. Specifically, areas with high and low thermal load do not form on the tube wall in the vicinity of the arc, but at the base points of the electrodes. Also the influence of gas convection in the discharge vessel changes greatly. The above described publications of the prior art do not describe whether the discharge vessel is being operated horizontally or vertically. Here therefore, in this respect, the influence of thermal load and gas convection within the discharge vessel is ignored.

In a television of the rear projection type, there is a demand for high picture quality. Especially in the case of using the above described super high pressure mercury lamp as the light source, is it regarded as a disadvantage that the illuminance of the picture fluctuates due to the radiance spot of the cathode with high radiance flickering due to gas convection or the like on the faces of the electrodes.

SUMMARY OF THE INVENTION

Therefore, a primary object of the present invention is to devise a high pressure mercury lamp which is operated with an internal pressure of at least one hundred and some dozen atm., in which the thermal load and gas convection are considered, and in which the cathode radiance spot is stable.

A particular object of the invention is to devise a high pressure mercury lamp which is oriented vertically and in which the above described defects in the prior art are eliminated.

In a high pressure mercury lamp in which a fused silica glass discharge vessel contains a pair of opposed electrodes, which is filled with mercury in an amount at least equal to 0.15 mg/mm$^3$ and rare gas, the objects of the invention are achieved by the length L1 (mm) that one of the electrodes projects into the discharge vessel being greater than the length L2 (mm) that the other electrode projects into the discharge vessel, and by the following conditions being met where the lamp wattage is W (watt) and the maximum value of the inside diameter in the direction perpendicular to the axis which joins the electrode pair within the discharge vessel is D (mm):

$$0.35\times(W)^{1/2}\leqq L1\leqq 0.69\times(W)^{1/2}$$

$$L2\leqq 0.76\times(W)^{1/2.643}$$

and at the same time $$(2.50)e^{0.0022W}\leqq D\leqq(5.0)e^{0.0034W}$$

In a first version of the invention, the electrode which projects into the discharge space with the greater length L1 is the anode, while the cathode projects into the discharge space with the shorter length L2.

In another version of the invention, the cathode projects into the discharge vessel with the length L1 that is greater than the length L2 that the anode projects into the discharge vessel. One such lamp can have at least 0.155 mg/mm$^3$ of mercury added, and the diameter D satisfies the formula:

$$(3.86)e^{0.0022W}\leqq D\leqq(3.91)e^{0.0034W},$$

W, again, being the lamp wattage in watts. L1 and L2 furthermore satisfy the aforementioned relations.

The lamp in accordance with the invention can be operated such that an axis which joins the two electrodes is aligned essentially vertically. The invention relates, therefore, also to an emission device in which the lamp is attached with a holding device such that one of the electrodes is located above the other. The electrode located at the top is thus the one which projects with a greater length (L1/mm) into the discharge space.

The objects of the invention are, at the same time, advantageously achieved in that the discharge vessel contains at least one halogen selected from among chlorine, bromine or iodine and at least one emission metal besides mercury.

The objects are, moreover, achieved by an emission device for a high pressure mercury lamp which comprises the above described high pressure mercury lamp and a feed device which supplies a stipulated power to this high pressure mercury lamp.

In the following the invention is further described using several embodiments which are shown in the drawings.

BRIEF DESCRIPTION OF THE DRAWINGS

FIG. 1 is a longitudinal sectional view of a high pressure mercury lamp in accordance with an embodiment of the invention;

FIG. 2 is a graph showing the spectral distribution in the high pressure mercury lamp of the invention;

FIG. 3 is a table of values of examples which show the action of the invention;

FIG. 6 is a table of numerical values of the high pressure mercury lamp of the invention.

DETAILED DESCRIPTION OF THE INVENTION

Figure 4:
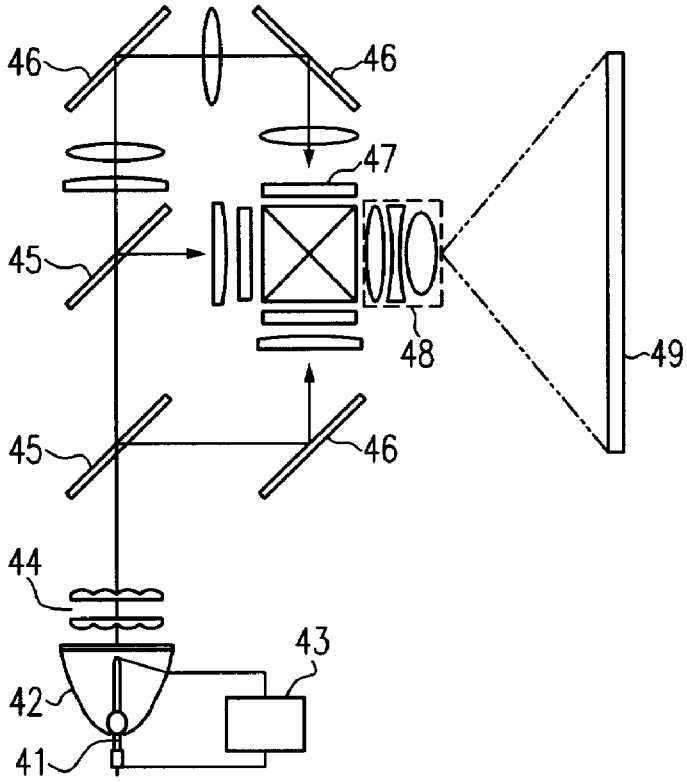
FIG. 4 is a schematic diagram of an emission device in accordance with the invention for a high pressure mercury lamp.

FIG. 1 schematically shows a high pressure mercury lamp in accordance with an embodiment of the invention in which a fused silica glass discharge lamp 1 has a discharge vessel 2 in the middle, and narrow, hermetically sealed portions 3 connected to opposite ends of the discharge vessel 2. In the discharge vessel 2 (hereinafter also called the "emission space"), there are a cathode 4 and an anode 5 at a distance from each other of 1.0 to 2.0 mm. The cathode 4 is located at the top, and its rear end extends into the hermetically sealed portion 3 and is connected to a metal foil 6. The anode 5 is located at the bottom, and its rear end, likewise, extends into the hermetically sealed portion 3 and is connected to a metal foil 6. An outer lead 7 is connected to the other end of the respective metal foil 6.

The emission space is filled with mercury as the emission material and a rare gas, such as argon, xenon or the like, as the starter gas for operation. For example, rare gas at a pressure of $5.3\times10^4$ Pa is added. Here, the amount of mercury added is at least equal to 0.155 mg/mm$^3$, by which the vapor pressure during stable operation is at least equal to one hundred and some dozen atm.

In the following one such high pressure mercury lamp is described by way of example:

Maximum outside diameter of the discharge vessel: 12.2 mm

Maximum inside diameter of the discharge vessel: 6.8 mm

Length of the emission space (length in the axial direction of the lamp): 12.7 mm Amount of mercury added: 43.9 mg Inside volume of the emission space: 251 mm$^3$ Inside area of the emission space: 200 mm$^2$ Tube wall load: 1 W/mm$^2$ Nominal wattage: 200 W Here, the length L1 ofthe cathode 4 which is positioned at the top and which projects into the discharge vessel 2 is greater than the length L2 of the anode 5 which projects into the discharge vessel 2 and which is positioned at the bottom. The length L1 of the cathode 4 which is positioned at the top and which projects into the discharge vessel 2 is, for example, 6.8 mm. The length L2 of the anode 5 which projects into the discharge vessel 2 and which is positioned at the bottom is 4.2 mm. In the bottom region in which the thermal load is low, the anode is positioned in the vicinity of the bottom end of the discharge vessel. This area can be heated not only by the thermal effect of the arc discharge, but also by the radiant heat from the anode. In this way, complete vaporization of the added mercury is enabled, and a high internal pressure of at least one hundred and some dozen atm can be achieved.

In this vertical operation, the upper area of the discharge space, due to vigorous gas convection, is subject to a extremely great thermal effect. When the cathode 4 projects far into the discharge vessel 2, as in the invention, the devitrification of the discharge vessel by the thermal effect can be advantageously prevented.

Furthermore, by the measure in accordance with the invention that the conditions:

$$0.35\times(W)^{1/2}\leqq L1\leqq 0.69\times(W)^{1/2}$$

and $$L2\leqq 0.76\times(W)^{1/2.64}$$

are satisfied, where W is the input energy to the lamp (W), L1 is the length of the projecting cathode 4 which is located at the top and L2 is the length of the projecting anode 5 which is located at the bottom, a sufficiently high operating pressure is obtained, and at the same time, a high pressure mercury lamp is obtained in which no devitrification or the like occurs. The inventors have conducted vigorous research for this purpose, based on the assumption that the lamp wattage has a great effect on the heat which forms in the discharge vessel, and that furthermore the length of the projecting cathode which is positioned at the top would influence the gas convection and the devitrification of the tube wall in the upper area of the discharge vessel.

In this way, they have ascertained the numerical range which is the optimum condition for this purpose.

Here, a case in which the length L1 of the projecting cathode which is positioned at the top is below the above described value of the lower limit, i.e., below $0.35\times(W)^{1/2}$, means that the upper space in the discharge vessel is small. Here, in the fused silica glass devitrification occurs due to the vigorous gas convection and the thermal effect in the discharge vessel.

On the other hand, a case in which the length L1 of the projecting cathode which is positioned at the top is above the above described value of the upper limit, i.e., above the value $0.69\times(W)^{1/2}$, means that the upper space in the discharge vessel is too large. Here, the mercury cannot vaporize sufficiently, and as a result, a high operating pressure cannot be obtained. Likewise, in the case in which the length L2 of the projecting anode positioned at the bottom is above $0.76\times(W)^{1/2.64}$, the lower space in the discharge vessel is too large and the temperature drops. Here, the mercury cannot vaporize sufficiently, and as a result, a high operating pressure cannot be obtained.

According to the invention, by the measure that condition $(3.86)e^{0.0022W} \leqq D \leqq 3.91^{0.0034W}$ is satisfied in this case, when the lamp wattage is W (W) and the maximum value of the inside diameter in the direction perpendicular to the axis which joins the pair of electrodes within the discharge vessel is D (mm), a mercury high pressure lamp is obtained in which a sufficiently high operating pressure can, likewise, be obtained and in which devitrification or the like can be prevented. The inventors have conducted vigorous research, as in the above described case, for this purpose based on the assumption that the lamp wattage has a great effect on the heat which forms in the discharge vessel, and that furthermore the above described inside diameter in the discharge vessel would influence the gas convection and the devitrification of the tube wall of the discharge vessel. In this way, they have ascertained the numerical range which forms the optimum condition for this purpose.

Here, a case in which the above described inside diameter D of the discharge vessel is below the above described value of the lower limit, i.e., below $(3.86)e^{0.0022W}$, means that the position of the arc is in the vicinity of the tube wall of the discharge vessel. As a result, there is the danger of devitrification in the arc tube.

On the other hand, a case in which the inside diameter D of the discharge vessel is above the above described value of the upper limit, i.e., above $(3.91)e^{0.0034W}$, means that the discharge vessel is too large. In this case, a sufficient operating pressure cannot be obtained.

Also, in the case in which the values for D are between $(2.50)e^{0.0022W} \leqq D \leqq 5.0^{\ 0.0034W}$, still usable lamps can fundamentally be obtained. However, if the electrode which projects with a greater length L1 into the discharge space is the cathode, the preferred values are in the range $(3.86)e^{0.0022W} \leqq D \leqq 3.91e^{0.0034W}$.

FIG. 2 shows a spectrum of the high pressure mercury lamp of the invention. As the drawings show, in the area of the visible radiation with wavelengths of roughly 380 to 760 nm, effective radiation is obtained. In particular, in the red range with wavelengths from 600 to 760 nm, continuous radiation occurs to a large extent. This shows that, in comparison to a conventional high pressure mercury lamp containing less than 0.155 $mg/mm^3$ of added mercury, extensive multiplication has occurred.

The high pressure mercury lamp in accordance with the invention is advantageously used with a lamp wattage in the range from 70 W to 250 W. FIG. 3 shows, for one embodiment, the values of the length L1 of the projecting electrode 4 positioned at the top and of the maximum value (D) of the inside diameter in the direction perpendicular to the axis which runs between the pair of electrodes in the discharge vessel in this area. Here, the electrode at the top is the cathode.

FIG. 4 schematically shows an emission device for a high pressure mercury lamp of the invention. In the figure, a high pressure discharge lamp 41 is located in a reflector 42. A power supply device 43 is electrically connected to the lamp 41. The radiant light from the lamp 41 is incident in the reflector 42 or directly into an integrator lens 44 and via several dichroitic mirrors 45 and reflectors 46 irradiates a liquid crystal cell 47. An image is projected onto a screen 49 via a projection lens 48. The lamp 41 is supplied with a predetermined power (W) from the supply device 43.

In the high pressure mercury lamp of the invention, in a lamp of the vertical operation type, by the measure that the length of the projecting electrode which is positioned at the top, the length of the projecting electrode which is positioned at the bottom, and the maximum value of the inside diameter in the direction perpendicular to the axis which joins the pair of electrodes in the discharge vessel are fixed, a sufficiently high operating pressure can be obtained, and at the same time, an advantageous measure against vigorous gas convection within the discharge vessel can be taken. This has enabled a high pressure mercury lamp with a long service life which is not filled with a halogen. It was specifically established that, in practice, 5000 hours of operation without problems can be achieved without adding a halogen.

The above described high pressure mercury lamp in accordance with the invention can also be used for a lamp of the AC operating type.

In the high pressure mercury lamp according to the invention a sufficiently long service life can be obtained without adding a halogen, as was described above. However, this does not mean that the addition of a halogen is precluded, and in fact, a halogen can also be added which has been chosen from among chlorine, bromine, and/or iodine, the halogen cycle can be used and thus the service life prolonged.

Furthermore, in a high pressure mercury lamp of the invention, by adding at least one emission metal besides mercury, the emission color of this metal can be used. This makes it possible to further improve color reproduction. As the emission metal for this purpose, for example, indium, zinc, cadmium, rare earth metals or the like can be added.

In the following, another embodiment of the invention is described using FIG. 5.

Here, a high pressure mercury lamp is shown which is operated vertically. In this case, the electrode positioned at the top is an anode and the electrode positioned at the bottom is a cathode.

The emission space is filled with mercury as the emission material and a rare gas such as argon, xenon or the like is provided as the starter gas for operation. For example, rare gas is added to a pressure of $1.3\times10^4$ Pa. Here, the amount of mercury added is greater than or equal to 0.15 $mg/mm^3$, by which the vapor pressure during stable operation is at least equal to one hundred and some dozen atm.

In the following one such high pressure mercury lamp is described by way of example:

Maximum outside diameter of the discharge vessel: 11 mm

Maximum inside diameter of the discharge vessel: 5.8 mm

Length of the emission space (length in the axial direction of the lamp): 12.4 mm Amount of mercury added: 33.3 mg Inside volume of the emission space: 190 $mm^3$ Inside surface of the emission space: 150 $mm^2$ Tube wall load: 1.33 $W/mm^2$ Nominal wattage: 200 W Here, the length L1 of the anode 5 which is positioned at the top and which projects into the discharge vessel 2 is greater than the length L2 of the cathode 4 which projects into the discharge vessel 2 and which is positioned at the bottom. The length L1 of the anode 5 which is positioned at the top and which projects into the discharge vessel 2 is, for example, 7.4 mm in the above described mercury lamp. The length L2 of the cathode 4 which projects into the discharge vessel 2 and which is positioned at the bottom is 3.5 mm. In the bottom region, in which the thermal load becomes low, the distance from the arc discharge is short. Therefore, this area can be heated by the thermal effect of the arc discharge and the radiation. This enables complete vaporization of the added mercury, and a high internal pressure at least equal to one hundred and some dozen atm can be achieved.

In this vertical operation, the upper area of the discharge space is subject to a extremely great thermal effect due to vigorous gas convection. However, when the anode 5 projects far into the discharge vessel 2, as in the invention, the distance between the arc discharge and the upper area of the discharge vessel is large, and the radiation from the arc is shielded by the large anode. In this way, the thermal effect of the arc discharge on the upper area of the discharge vessel is reduced. Furthermore, the convection which rises parallel to the arc axis is robbed of heat by the anode, and thus, the temperature of the air flow drops. In this way, the thermal load on the upper area of the discharge vessel 2 is also reduced and the devitrification of the discharge vessel can be advantageously prevented.

Furthermore, by the measure according to the invention that both of the conditions $0.35\times(W)^{1/2} \leqq L1 \leqq 0.69\times(W)^{1/2}$ and $L2 \leqq 0.76\times(W)^{1/2.64}$ are satisfied, where W is the input energy to the lamp (W), L1 is the length ofthe projecting anode 5 which is located at the top, and L2 is the length of the projecting cathode 4 which is located at the bottom, a sufficiently high operating pressure is obtained, and at the same time, a high pressure mercury lamp results in which no devitrification or the like occurs. The inventors have found that, for this purpose, the lamp wattage has a great effect on the heat which forms in the discharge vessel, and furthermore, that the length of the projecting anode which is positioned at the top has an influence on the gas convection and the devitrification of the tube wall in the upper area of the discharge vessel. As a result of vigorous research they have ascertained the numerical range which offers the optimum condition for this purpose.

The reason for fixing the value of the lower limit and the value of the upper limit of the length L1 of the projecting anode which is positioned at the top is the same as in the above described arrangement in which the cathode is positioned at the top. The reason for fixing the value of the upper limit of the length L2 of the projecting cathode which is positioned at the bottom is likewise the same as in the arrangement in which the anode is positioned at the bottom.

In the invention, the condition $(2.50)e^{0.0022W} \leqq D \leqq (5.0)e^{0.0034W}$ is met where W is the lamp wattage (W) and the maximum value of the inside diameter in the direction perpendicular to the axis which forms between the two electrodes within the discharge vessel is D (mm). The reason for this is also the same as in the above described arrangement in which the cathode is positioned at the top.

In a high pressure mercury lamp, due to collisions of the vigorous air flow as it rises along the arc axis, in the vicinity of the electrode positioned at the top, the air flow becomes turbulent, causing the electrode radiance spot to become unstable. However, with respect to the invention, the inventors have found that the convection in the vicinity of the electrode positioned at the bottom is mild, and therefore, the electrode radiance spot is extremely stabilized.

In the case in which a large anode is located at the top, the effect of the thermal load on the upper area of the discharge vessel due to convection is different than in the above described other operating process (specifically in AC operation and in DC operation in which the anode is located at the bottom and the cathode at the top). Therefore, with consideration of this point, one especially preferred range of the inside diameter in the discharge vessel is fixed by the invention for the case where the cathode is located at the top.

At the same time, when the anode is located at the top, the lamp of the invention can be operated with direct current, while in the case where the cathode is located at the top, advantageously, either direct current or alternating current can be used.

Figure 5:
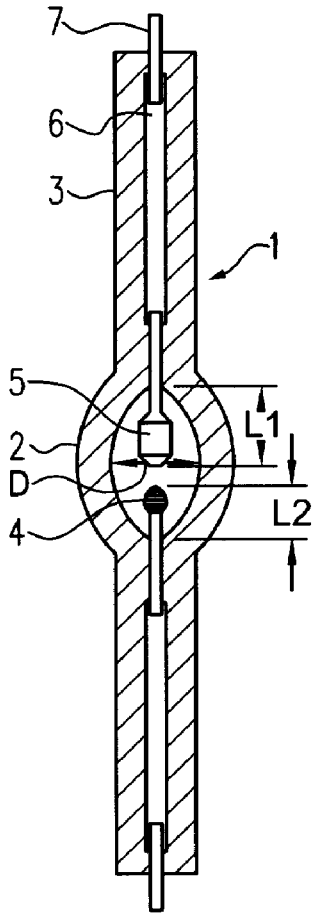
FIG. 5 is a schematic depiction of another embodiment of the high pressure mercury lamp in accordance with the invention.

The spectrum shown in FIG. 2 is obtained in the high pressure mercury lamp in the embodiment shown in FIG. 5.

In the high pressure mercury lamp in accordance with the FIG. 5 embodiment of the invention, at a lamp wattage of 130 W, L1 is in the range from 3.98 to 7.87 mm, L2 is less than or equal to 4.80 mm, and D is in the range from 3.33 to 7.78 mm. Furthermore, at a lamp wattage of 200 W, L1 is in the range from 4.95 to 9.76 mm, L2 is less than or equal to 5.65 mm, and D is in the range from 3.88 to 9.87 mm.

FIG. 6 is a table of the numerical values for examples of the high pressure mercury lamp according to the invention. In these examples, at the respective lamp wattage of 130 W and 200 W the amount of mercury added, the length L1 of the anode which projects into the discharge vessel, the length L2 of the cathode which projects into the discharge vessel, and the maximum value D of the inside diameter of the discharge vessel 2 and the arc length AL were varied. The conditions that the length L1 of the anode projecting into the discharge vessel is greater than the length L2 of the cathode projecting into the discharge vessel (condition 1), that $0.35\times(W)^{1/2} \leqq L1 \leqq 0.69\times(W)^{1/2}$ is satisfied for the lamp wattage W (W) and the length L1 of the projecting anode (condition 2), that $L2 \leqq 0.76\times(W)^{1/2.64}$ is satisfied (condition 3) where the length of the projecting cathode is L2, and that $(2.50)e^{0.0022W} \leqq D \leqq (5.0)e^{0.0034W}$ is sati the lamp wattage is W (W) and D (mm) is the maximum value of the inside diameter in the direction perpendicular to the axis which forms between the two electrodes within the discharge vessel (condition 4).

FIG. 6 clearly shows that of the lamps with a lamp wattage of 130 W lamps nos. 1 to 5 did not meet one of conditions 1 to 4 and the problem arose that a sufficient operating pressure was not obtained or devitrification occurred in the upper area of the discharge vessel 2. On the other hand, lamp no. 6 which mets all of conditions 1 to 4, retained 60% of its original light flux even after roughly 5000 hours of operation and did not have the above described problems.

Also, of the lamps with a lamp wattage of 200 W, lamps nos. 7 to 11 did not meet one of conditions 1 to 4 and had the problem that a sufficient operating pressure was not obtained or devitrification occurred in the upper area of the discharge vessel 2. On the other hand, lamp No. 12 which met all of conditions 1 to 4 retained 53% of its original light flux even after roughly 5000 hours of operation and did not have the above described problems.

The emission device for the high pressure mercury lamp in this embodiment is the same as in FIG. 4, differing only in that the anode is located at the top and the cathode is located at the bottom.

In the high pressure mercury lamp in accordance with the invention, in a lamp of the vertical operation type, by the measure that the length ofthe projecting anode which is positioned at the top, the length of the projecting cathode which is positioned at the bottom, and the maximum value of the inside diameter in the direction perpendicular to the axis which joins the pair of electrodes in the discharge vessel are fixed, a sufficiently high operating pressure can be obtained, and at the same time, an advantageous measure against vigorous gas convection within the discharge vessel 2 can be taken. This has enabled a high pressure mercury lamp with a long service life which is not filled with a halogen. It was specifically established that 5000 hours of operation without problems in practice can be maintained without halogen filling.

Furthermore, in the high pressure mercury lamp of the invention, by the measure that the cathode is located at the bottom, the cathode radiance spot can be made extremely stable with high radiance. In the case of using a projection television as the light source, this makes it possible to obtain a good image with extremely low fluctuation of illuminance.

Moreover, in the high pressure mercury lamp according to the invention, a sufficiently long service life can be obtained without adding a halogen, as was described above. However, this does not mean that the addition of a halogen is precluded, and a halogen can also be provided in addition, the halogen being chosen from among chlorine, bromine, and/or iodine, and thus, the halogen cycle can be used and the service life of the lamp prolonged.

Furthermore, in a high pressure mercury lamp in accordance with the invention, by adding at least one emission metal besides mercury, the emission color of this metal can be used. This makes it possible to further improve color reproduction. As the emission metal for this purpose for example indium, zinc, cadmium, rare earth metals or the like can be added.

Action of the Invention

As was described above, in the high pressure mercury lamp of the invention, by the measure that the discharge vessel 2 contains at least 0.15 mg/mm$^3$ mercury or the like, and that the lengths of the projecting electrodes, the maximum inside diameter of the discharge vessel, the lamp wattage and the like are fixed as described, a high internal pressure of one hundred and some dozen atm can be obtained, and in this way, continuous spectra in the visible radiation range, especially in the red range, can be increased significantly.

Even under these extremely high pressure conditions a lamp can be devised in which the problems of thermal load, gas convection and the stability ofthe cathode radiance spot in the arc are advantageously considered. Thus, it was possible to achieve an extremely long operating service life of greater than or equal to 5000 hours.

What we claim is:

1. High pressure mercury lamp comprising a fused silica glass discharge vessel containing a pair of opposed electrodes and mercury in an amount at least equal to 0.15 mg/mm$^3$ and rare gas; wherein a length L1 (mm) that one of the electrodes projects into the discharge vessel is greater than a length L2 (mm) that the other electrode projects into the discharge vessel; and wherein the following conditions are met for a lamp wattage W (watt) and a maximum value of an inside diameter D (mm) of the discharge vessel in a direction perpendicular to an axis which joins the pair of electrodes:

$$0.35\times(W)^{1/2}\leqq L1\leqq 0.69\times(W)^{1/2}$$

$$L2\leqq 0.76\times(W)^{1/2.64}$$

and at the same time $$(2.50)e^{0.0022}\leqq D\leqq(5.0)e^{0.0034W}.$$

2. High pressure mercury lamp as claimed in claim 1, wherein the electrode which projects into the discharge vessel with the greater length L1 is a cathode and the electrode which projects into the discharge vessel with the shorter length L2 is the anode; and wherein the amount of mercury added is at least equal to 0.155 mg/mm$^3$ and the maximum value of the inside diameter D satisfies the following condition:

$$(3.86)e^{0.0022W}\leqq D\leqq(3.91)e^{0.0034W}.$$

3. High pressure mercury lamp as claimed in claim 1, wherein the electrode which projects into the discharge vessel with a greater length L1 is the anode and the electrode which projects into the discharge vessel with the shorter length L2 is the cathode.

4. High pressure mercury lamp as claimed in claim 1, wherein the discharge vessel also contains at least one halogen which has been selected from the group consisting of chlorine, bromine or iodine.

5. High pressure mercury lamp as claimed in claim 2, wherein the discharge vessel contains at least one halogen which has been selected from group consisting of chlorine, bromine or iodine.

6. High pressure mercury lamp as claimed in claim 3, wherein the discharge vessel contains at least one halogen which has been selected from the group consisting of chlorine, bromine or iodine.

7. High pressure mercury lamp as claimed in claim 1, wherein the discharge vessel contains at least one emission metal in addition to mercury.

8. High pressure mercury lamp as claimed in claim 2, wherein the discharge vessel contains at least one emission metal in addition to mercury.

9. High pressure mercury lamp as claimed in claim 3, wherein the discharge vessel contains at least one emission metal in addition to mercury.

10. Emission device which comprises a high pressure mercury lamp having a fused silica glass discharge vessel containing a pair of opposed electrodes and mercury in an amount at least equal to 0.15 mg/mm$^3$ and rare gas; wherein a length L1 (mm) that one of the electrodes projects into the discharge vessel is greater than a length L2 (mm) that the other electrode projects into the discharge vessel; and wherein the following conditions are met for a lamp wattage W (watt) and a maximum value of an inside diameter D (mm) of the discharge vessel in a direction perpendicular to an axis which joins the pair of electrodes:

$$0.35\times(W)^{1/2}\leqq L1\leqq 0.69\times(W)^{1/2}$$

$$L2\leqq 0.76\times(W)^{1/2.64}$$

and at the same time $$(2.50)e^{0.0022W} \leqq D \leqq (5.0)e^{0.0034W}$$

and a holding device in which the high pressure mercury lamp is located such that an axis which joins the electrodes is oriented essentially vertically and the electrode which projects into the discharge space with the greater length L1 is located above the electrode which projects into the discharge space with the shorter length L2 into the discharge space.

11. Emission device as claimed in claim 10, wherein the electrode which projects into the discharge space with a greater length L1 is a cathode and the electrode which projects into the discharge space with the shorter length L2 is an anode; wherein the amount of mercury added is at least equal to 0.155 mg/mm$^3$, and wherein the diameter D satisfies the condition:

$$(3.86)e^{0.0022W} \leqq D \leqq (3.9)e^{0.0034W}$$

12. Emission device as claimed in claim 10, wherein the electrode which projects into the discharge space with a greater length L1 is an anode and the electrode which projects into the discharge space with the shorter length L2 is a cathode.

13. Emission device as claimed in claim 10, wherein the discharge vessel contains at least one halogen which has been selected from the group consisting of chlorine, bromine or iodine.

14. Emission device as claimed in claim 11, wherein the discharge vessel contains at least one halogen which has been selected from the group consisting of chlorine, bromine or iodine.

15. Emission device as claimed in claim 12, wherein the discharge vessel contains at least one halogen which has been selected from the group consisting of chlorine, bromine or iodine.

16. Emission device as claimed in claim 10, wherein the discharge vessel contains at least one emission metal in addition to mercury.

17. Emission device as claimed in claim 11, wherein the discharge vessel contains at least one emission metal in addition to mercury.

18. Emission device as claimed in claim 12, wherein the discharge vessel contains at least one emission metal in addition to mercury.

19. Emission device as claimed in claim 10, which further comprises a concave reflector which is pointed upward, which surrounds the high pressure mercury lamp, and which has an optical axis aligned with the axis which joins the electrodes of the high pressure mercury lamp, and a power supply device for supplying the high pressure mercury lamp with a predetermined power.

20. Emission device as claimed in claim 11, which further comprises a concave reflector which is pointed upward, which surrounds the high pressure mercury lamp, and which has an optical axis aligned with the axis which joins the electrodes of the high pressure mercury lamp, and a power supply device for supplying the high pressure mercury lamp with a predetermined power.

21. Emission device as claimed in claim 12, which further comprises a concave reflector which is pointed upward, which surrounds the high pressure mercury lamp, and which has an optical axis aligned with the axis which joins the electrodes of the high pressure mercury lamp, and a power supply device for supplying the high pressure mercury lamp with a direct current of a predetermined power.

22. Emission device as claimed in claim 13, which further comprises a concave reflector which is pointed upward, which surrounds the high pressure mercury lamp, and which has an optical axis aligned with the axis which joins the electrodes of the high pressure mercury lamp, and a power supply device for supplying the high pressure mercury lamp with a predetermined power.

23. Emission device as claimed in claim 14, which further comprises a concave reflector which is pointed upward, which surrounds the high pressure mercury lamp, and which has an optical axis aligned with the axis which joins the electrodes of the high pressure mercury lamp, and a power supply device for supplying the high pressure mercury lamp with a predetermined power.

24. Emission device as claimed in claim 15, which further comprises a concave reflector which is pointed upward, which surrounds the high pressure mercury lamp, and which has an optical axis aligned with the axis which joins the electrodes of the high pressure mercury lamp, and a power supply device for supplying the high pressure mercury lamp with a direct current of a predetermined power.

25. Emission device as claimed in claim 16, which further comprises a concave reflector which is pointed upward, which surrounds the high pressure mercury lamp, and which has an optical axis aligned with the axis which joins the electrodes of the high pressure mercury lamp, and a power supply device for supplying the high pressure mercury lamp with a predetermined power.

26. Emission device as claimed in claim 17, which further comprises a concave reflector which is pointed upward, which surrounds the high pressure mercury lamp, and which has an optical axis aligned with the axis which joins the electrodes of the high pressure mercury lamp, and a power supply device for supplying the high pressure mercury lamp with a predetermined power.

27. Emission device as claimed in claim 18, which further comprises a concave reflector which is pointed upward, which surrounds the high pressure mercury lamp, and which has an optical axis aligned with the axis which joins the electrodes of the high pressure mercury lamp, and a power supply device for supplying the high pressure mercury lamp with a direct current of a predetermined power.

* * * * *